US008188641B2

(12) United States Patent
Kameda et al.

(10) Patent No.: US 8,188,641 B2
(45) Date of Patent: May 29, 2012

(54) SPARK PLUG

(75) Inventors: Hiroyuki Kameda, Aichi (JP); Katsutoshi Nakayama, Nagoya (JP); Satoshi Nagasawa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/743,851

(22) PCT Filed: Nov. 20, 2008

(86) PCT No.: PCT/JP2008/071087

§ 371 (c)(1),
(2), (4) Date: May 20, 2010

(87) PCT Pub. No.: WO2009/066716

PCT Pub. Date: May 28, 2009

(65) Prior Publication Data

US 2010/0264804 A1 Oct. 21, 2010

(30) Foreign Application Priority Data

Nov. 20, 2007 (JP) ..... 2007-300824
Feb. 7, 2008 (JP) ..... 2008-027969

(51) Int. Cl.
*H01T 13/20* (2006.01)

(52) U.S. Cl. ..... 313/142; 313/141

(58) Field of Classification Search ..... 313/141, 313/142

See application file for complete search history.

(56) References Cited

U.S. PATENT DOCUMENTS

| | | | |
|---|---|---|---|
| 4,700,103 | A | 10/1987 | Yamaguchi et al. |
| 5,488,262 | A | 1/1996 | Takamura |
| 5,502,351 | A | 3/1996 | Katoh et al. |
| 6,215,235 | B1 | 4/2001 | Osamura |
| 6,724,132 | B2 | 4/2004 | Kanao |
| 7,084,558 | B2 | 8/2006 | Teramura et al. |
| 7,321,187 | B2 | 1/2008 | Teramura et al. |
| 2002/0021066 | A1 | 2/2002 | Kanao |
| 2002/0038992 | A1 | 4/2002 | Morita et al. |
| 2002/0067111 | A1 | 6/2002 | Shibata et al. |
| 2002/0093277 | A1 | 7/2002 | Hiramatsu |
| 2004/0041506 | A1 | 3/2004 | Teramura et al. |
| 2006/0238092 | A1 | 10/2006 | Teramura et al. |

FOREIGN PATENT DOCUMENTS

| | | | |
|---|---|---|---|
| JP | 61-045583 | A | 3/1986 |
| JP | 5-166577 | A | 7/1993 |
| JP | 5-198348 | A | 8/1993 |
| JP | 6-310256 | A | 11/1994 |
| JP | 11-121142 | A | 4/1999 |
| JP | 11-233233 | A | 8/1999 |
| JP | 2002-83662 | A | 3/2002 |

(Continued)

*Primary Examiner* — Bumsuk Won
(74) *Attorney, Agent, or Firm* — Sughrue Mion, PLLC

(57) ABSTRACT

A center electrode includes a tapered electrode base member mount and a noble metal tip joined to the electrode base member mount via a fused portion in which the component of the noble metal tip and the component of the electrode base member mount are fused. In this state, the cross section area S1 at a tip side boundary between the fused portion and the noble metal tip and the cross section area S2 at a base member side boundary between the fused portion and the electrode base member mount satisfy the relational expression of S1<S2. Regarding the cross section area S3 at the base portion of the electrode base member mount, (S3−S2)/D satisfies the relational expression of 5≦(S3−S2)/D≦50. D is the shortest distance in the axis line direction from the base member side boundary to the base portion.

2 Claims, 8 Drawing Sheets

FOREIGN PATENT DOCUMENTS

| | | | |
|---|---|---|---|
| JP | 2002-289321 | A | 10/2002 |
| JP | 2002-324650 | A | 11/2002 |
| JP | 2004-127916 | A | 4/2004 |
| JP | 2004-134209 | A | 4/2004 |
| JP | 2005-235789 | A | 9/2005 |
| JP | 2007172866 | A | 7/2007 |

SPARK PLUG

TECHNICAL FIELD

The present invention relates to a spark plug.

BACKGROUND ART

For a spark plug, not only a longer life for realizing maintenance-free but also an improvement in ignition performance and an improvement in combustion efficiency by reducing a size of electrode have been demanded. In order to satisfy these demands, a spark plug including a noble metal tip of platinum, iridium, or the like joined to a spark discharge portion of a center electrode has been frequently used. To further improve the ignition performance, it has been proposed that noble metal tips are joined not only to the center electrode but also to a ground electrode (outer electrode) (refer to Patent Document 1).

Patent Document 1: JP-A-11-121142

When such a noble metal tip is joined, in order to prevent a removal of the noble metal tip from the electrode base member, a method is used in which, for example, on the center electrode, the noble metal tip is placed on the front end of the center electrode base member and the boundary between the noble metal tip and the front end of the center electrode base member is directly melted by a laser, etc. By thus melting, a fused portion with a comparatively large volume is formed at a joint portion between the noble metal tip and the center electrode base member. This fused portion is made of an alloy containing the component of the noble metal tip and the component of the center electrode base member (for example, a nickel-based material). As a result, the fused portion has a thermal expansion coefficient which is intermediate between the thermal expansion coefficient of the noble metal tip and the thermal expansion coefficient of the center electrode base member, and functions as a stress relaxing layer with a comparatively large volume. Therefore, as aforementioned, the effectiveness in preventing the removal increases.

DISCLOSURE OF THE INVENTION

Problem to be Solved by the Invention

When a noble metal tip is provided on the center electrode base member, if a length from the front end of the noble metal tip to the fused portion formed between the noble metal tip and the front end of the center electrode base member is approximately 0.3 mm, it is regarded as possible to secure ignition performance and durability in an existing engine. However, in recent years, the engine itself is improved in performance in such a way that the compression ratio in the combustion chamber is made higher. As a result, a further improvement in a spark plug having a noble metal tip joined to the center electrode base member has been demanded.

For example, when a noble metal tip joined to the center electrode base member is made longer, spark discharge positions come closer to the center side of the combustion chamber, thereby to improve the ignition performance. On the other hand, the heat conduction property of the noble metal tip caused by the combustion heat in the combustion chamber becomes worse as the length of the noble metal tip (hereinafter also referred to as tip length) increases, which may deteriorate the durability.

In view of the above-described problems, from a standpoint of focusing on the length of the noble metal tip and the shape of the fused portion which has not been attempted conventionally, the present invention is for realizing both of an improvement in ignition performance and an improvement in durability. An object of the present invention is to provide a new spark plug which can realize both of an improvement in ignition performance and an improvement in durability while a noble metal tip joined to the front end of the center electrode base member is made longer.

Means for Solving the Problem

To achieve the above-described object, the following configuration is adopted in the present invention.

Example of Application

Spark Plug

A spark plug comprises: a center electrode; an insulating body which has an axial hole extending in an axis line direction and holds the center electrode in the axial hole; a metal shell which holds the insulating body and surrounds a radial periphery of the insulating body; and a ground electrode having one end portion joined to the metal shell and the other end portion, the ground electrode being bent such that the other end portion opposes a front end portion of the center electrode so as to form a spark gap between the other end portion and the center electrode, wherein the center electrode comprises: an electrode base member comprising an electrode base member mount tapered in a front end portion thereof such that a diameter thereof is reduced toward a front end side; and a noble metal tip joined to a front end surface of the electrode base member mount, wherein the noble metal tip and the electrode base member are joined via a fused portion in which a component of the noble metal tip and a component of the electrode base member mount are fused, and $CL \geqq 0.5$ mm is satisfied where CL is a shortest distance in the axis line direction from a tip side boundary defined between the fused portion and the noble metal tip to a front end of the noble metal tip, and wherein $S1 < S2$ and $5 \leqq (S3 - S2)/D \leqq 50$ are satisfied where S1 is a cross section area of the tip side boundary, S2 is a cross section area of a base member side boundary defined between the fused portion and the electrode base member mount, S3 is a cross section area of a base portion of the electrode base member mount, and D is a shortest distance in the axis line direction from the base member side boundary to the base portion.

In this case, it is suitable for the actual situation to calculate the cross section areas S1 to S3 and the shortest distances (lengths) D and CL in the above-described relational expression in units of millimeters according to the actual dimensions of a spark plug to be mounted in an internal combustion. As an example of actual dimensions, radiuses at the boundaries described above for calculating the above-described cross section areas S1 to S3 are approximately not more than 1.5 mm.

In the spark plug configured as described above, when a noble metal tip is melted and joined to the front end face of a tapered electrode base member mount via the fused portion, the cross section area S1 of the tip side boundary between the fused portion and the noble metal tip and the cross section area S2 of the base member side boundary between the fused portion and the electrode base member mount are set so as to satisfy the first relational expression of $S1 < S2$. The electrode base member mount is tapered such that the diameter thereof is reduced toward the front end side. As a matter of course, the cross section area S3 of the base portion of the electrode base member mount is larger than the cross section area S2 of the base member side boundary. Therefore, from the noble metal tip to the base portion of the electrode base member mount, the cross section area increases in the order of the noble metal tip, the fused portion, and the electrode base member mount. Therefore, there is no special problem with heat conduction from the noble metal tip as long as the noble metal tip is a conventional short-length noble metal tip. On the other hand, when the above-described relationship among the cross section areas is simply maintained and the length of the noble metal tip is increased (the shortest distance CL (corresponding to tip length) in the axis line direction from the tip side boundary to the front end of the noble metal tip is set to 0.5 millimeters or more), the cross section becomes progressively increases from the noble metal tip to the base portion of the electrode base member mount, but it is expected that heat conduction from the noble metal tip is deteriorated according to the increase in tip length.

On the other hand, in the spark plug configured as described above, in addition to the above-described relationship (S1<S2), the cross section area S2 of the base member side boundary between the fused portion and the electrode base member mount and the cross section area S3 of the base portion of the electrode base member mount are set so as to satisfy a second relational expression of $5 \leqq (S3-S2)/D \leqq 50$ which indicates that (S3−S2)/D showing an area increase rate per unit length from the base member side boundary to the base portion is from 5 to 50, where D is the shortest distance in the axis line direction from the base member side boundary to the base portion. Accordingly, when the heat of the noble metal tip is conducted to the base portion of the electrode base member mount through the fused portion, the heat propagation distance from the base member side boundary to the base portion in the axis line direction of the electrode base member mount becomes shorter. Further, the heat propagation area at the time of heat propagation suddenly spreads as defined by the second relational expression of $5 \leqq (S3-S2)/D \leqq 50$. Therefore, even when the tip length of the noble metal tip is made longer (0.5 mm or more) than an existing one, heat conduction from the noble metal tip is possible without problems. As a result, both of an improvement in ignition performance and an improvement in durability can be realized while the noble metal tip is made longer.

The spark plug may be embodied as follows. For example, in the spark plug in which: the center electrode (20) is held by the insulating body in a state where at least the noble metal tip (90), the fused portion (23), and the electrode base member mount (22) are exposed from the insulating body; the ground electrode (30A) is bent such that the other end portion of the ground electrode opposes a side surface of the noble metal tip (90); and the spark gap GA is formed between the other end portion of the ground electrode (30A) and the side surface of the noble metal tip (90), $GB/GA \geqq 1.05$ is satisfied where GB is a shortest distance from the other end portion of the ground electrode (30A) to the tip side boundary (K1). Thus, by defining the spark gap GA between the other end portion of the ground electrode and the side surface of the noble metal tip and the shortest distance GB from the other end portion of the ground electrode to the tip side boundary so as to satisfy the above-described relational expression ($GB/GA \geqq 1.05$), even if minute bumps are formed on the surface of the fused portion or an oxide film is formed thereon, the spark discharge from the fused portion to the other end portion of the ground electrode can be reduced. Therefore, ignition performance of the spark plug having a spark gap formed between the other end face of the ground electrode and the side surface of the noble metal tip can be improved.

Further, the shortest distance CL in the axis line direction from the tip side boundary to the front end of the noble metal tip and the cross section area S1 of the tip side boundary are set so as to satisfy the relational expression of $1.4 \leqq CL/S1 \leqq 7.2$. By satisfying the relational expression ($1.4 \leqq CL/S1 \leqq 7.2$), the noble metal tip can be made longer while both of an improvement in ignition performance and an improvement in durability are realized.

DESCRIPTION OF REFERENCE SIGNS

Figure 1:
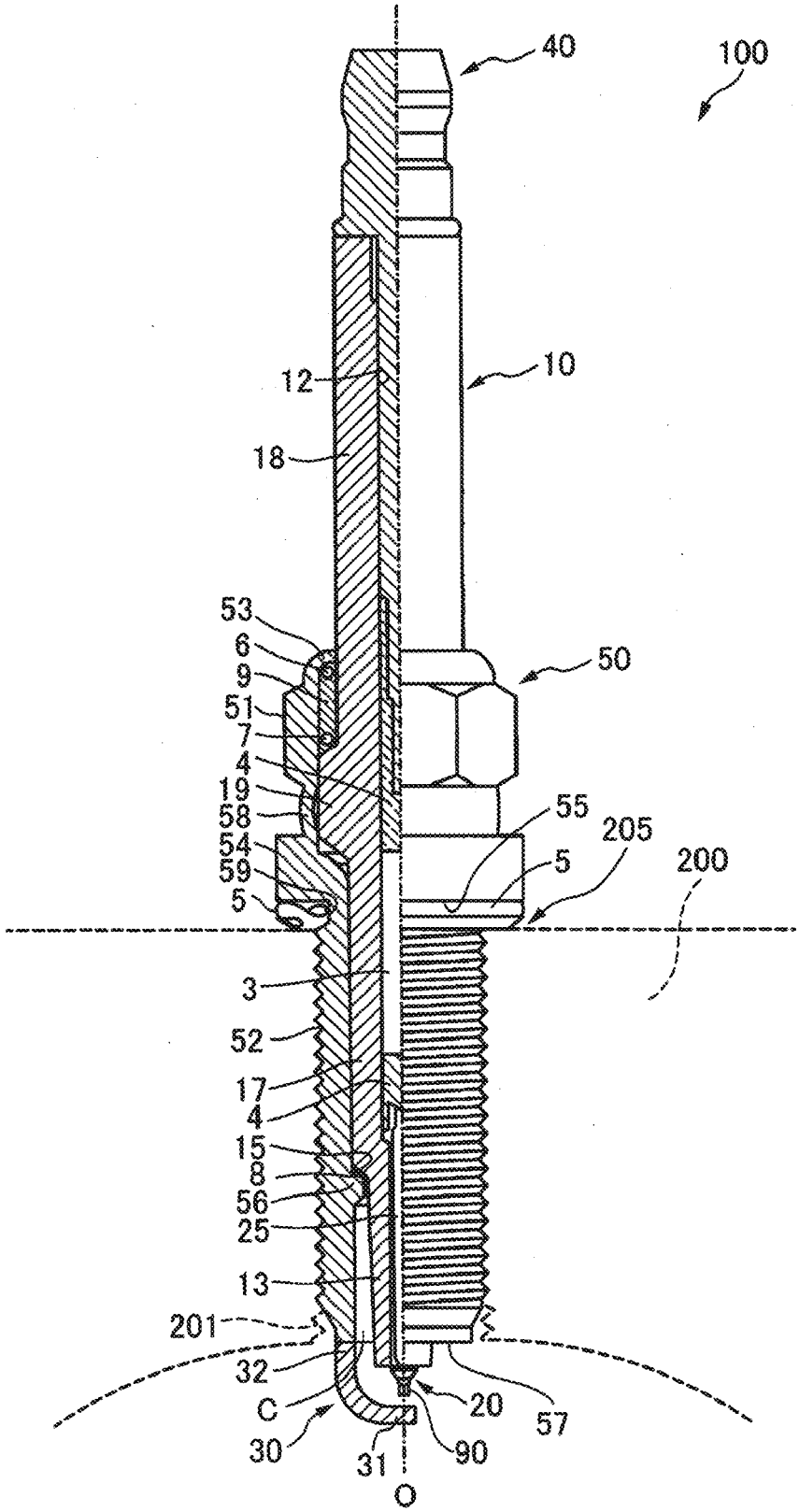
FIG. 1 is a partial sectional view of a spark plug as an embodiment of the present invention.

3: Ceramic resistor
4: Sealing member
5: Gasket
6: Ring member
8: Plate packing
9: Talc
10: Insulator
11: Front end portion
12: Axial hole
13: Leg portion
15: Step portion
17: Front side barrel portion
18: Rear side barrel portion
19: Flange portion
20: Center electrode
21: Electrode base member
22: Electrode base member mount
23: Fused portion
25: Core member
30: Ground electrode
30A: Ground electrode
31: Distal end portion
31A: Distal end portion
32: Base portion
32A: Base portion
40: Terminal fitting
50: Metal shell
51: Tool engagement portion
52: Attaching threaded portion

53: Crimping portion
54: Seal portion
55: Bearing surface
56: Step portion
57: Front end face
58: Buckling portion
59: Screw neck
90: Electrode tip
91: Electrode tip
100: Spark plug
100A: Spark plug
200: Engine head
201: Attaching threaded hole
205: Opening peripheral portion
O: Axis line
K1: Tip side boundary
K2: Base member side boundary
K2: Tapered base portion
G, GA: Spark gap
GB: Shortest distance
CL: Tip effective length

BEST MODE FOR CARRYING OUT THE INVENTION

Figure 2:
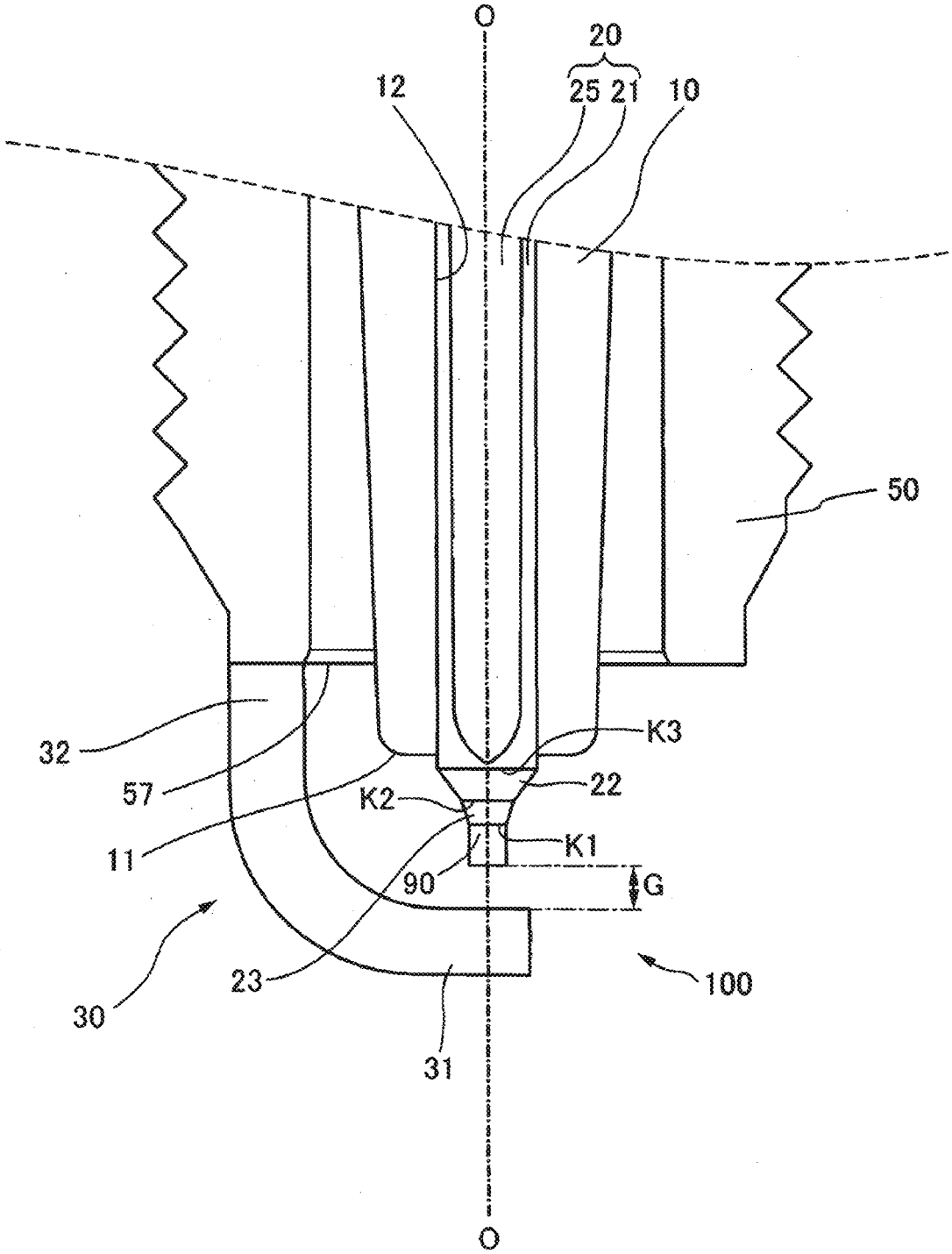
FIG. 2 is an enlarged view of the vicinity of the front end of a center electrode in the spark plug.

Hereinafter, an embodiment of the present invention will be described based on an embodiment. FIG. 1 is a partial sectional view of a spark plug 100 as an embodiment of the present invention, and FIG. 2 is an enlarged view of the vicinity of the front end of a center electrode 20 in the spark plug 100. In the following description, when describing the up-down direction, the axis line O direction of the spark plug 100 shown in FIG. 1 is defined as the up-down direction, and the lower side is defined as the front end side of the spark plug 100, and the upper side is defined as the rear end side.

As shown in FIG. 1, the spark plug 100 includes an insulator 10 as an insulating body, a metal shell 50 which holds this insulator 10, a center electrode 20 held in the axis line O direction inside the insulator 10, a ground electrode 30, and a terminal fitting 40 provided on a rear end portion of the insulator 10.

The insulator 10 is formed by sintering alumina, etc., as generally known and has a cylindrical shape having an axial hole 12 formed so as to extend in the axis line O direction around the axis. The insulator 10 includes a flange portion 19, a rear side barrel portion 18, a front side barrel portion 17, and a leg portion 13. The flange portion 19 is formed at substantially the center in the axis line O direction of the insulator 10, and has the largest outer diameter in the insulator 10. The rear side barrel portion 18 is formed on the further rear end side (upper side in FIG. 1) than the flange portion 19. The front side barrel portion 17 is formed on the further front end side (lower side in FIG. 1) than the flange portion 19, and has an outer diameter smaller than that of the rear side barrel portion 18. The leg portion 13 is formed on the further front end side than the front side barrel portion 17, and has an outer diameter smaller than that of the front side barrel portion 17. The diameter of the leg portion 13 is reduced toward the front end side, and the leg portion 13 is exposed to the combustion chamber when the spark plug 100 is attached to an engine head 200 of an internal combustion. A step portion 15 is formed between the leg portion 13 and the front side barrel portion 17.

As shown in FIG. 2, the center electrode 20 includes an electrode base member 21 and a core member 25 buried inside the electrode base member 21, and has a rod shape. The electrode base member 21 is made of nickel or an alloy containing nickel as a major component such as INCONEL (trade name) 600 or 601. The core member 25 is made of copper having greater heat conductivity than the electrode base member 21 or an alloy containing copper as a major component. Normally, the center electrode 20 is manufactured by filling the core member 25 inside the electrode base member 21 formed into a bottomed cylindrical shape and drawing it by extrusion molding from the bottom side. The core member 25 has a substantially constant outer diameter at its body portion, however, it is tapered on the front end side.

The front end portion of the center electrode 20, specifically, the front end portion of the electrode base member 21 includes: an electrode base member mount 22 tapered such that the diameter thereof is reduced toward the front end; a fused portion 23; and an electrode tip 90. This front end portion including the electrode tip 90 protrudes toward the further front end side than the front end portion 11 of the insulator 10. The electrode tip 90 is formed by containing a noble metal with a high melting point as a major component to improve its spark wear resistance. This electrode tip 90 is made, for example, of iridium (Ir) or an Ir alloy. The Ir alloy is an Ir alloy which contains Ir as a major component and to which one or two or more kinds among platinum (Pt), rhodium (Rh), ruthenium (Ru), palladium (Pd), and rhenium (Re) are added. As a detailed example, an Ir-5Pt alloy (an iridium alloy containing platinum in an amount of 5 mass %) and an Ir-11Ru-8Rh-1Ni alloy (an iridium alloy containing ruthenium in an amount of 11 mass %, rhodium in an amount of 8 mass %, and nickel in an amount of 1 mass %) are frequently used.

The fused portion 23 is formed by welding the electrode tip 90 to the electrode base member mount 22, for example, laser welding in which a laser is irradiated and the heat of the laser melts the electrode base member mount 22 and the electrode tip 90. In other words, in a state where the electrode tip 90 is disposed on the front end face of the electrode base member mount 22, while irradiating a laser onto the boundary surface between the electrode base member mount 22 and the electrode tip 90, the irradiation point is moved around once across the entire circumference of the boundary surface. In this laser welding, both materials (the component material of the electrode base member mount 22 and the noble metal of the electrode tip 90) are fused and mixed by the laser irradiation. Accordingly, the electrode tip 90 and the electrode base member mount 22 are firmly joined to each other, and a fused portion 23 which connects the electrode base member mount 22 and the electrode tip 90 is formed. This fused portion 23 is formed as an alloy of both materials by fusing of both materials.

The center electrode 20 extends inside the axial hole 12 toward the rear end side, and is electrically connected to the terminal fitting 40 on the rear side (upper side in FIG. 1) via a sealing member 4 and a ceramic resistor 3 (see FIG. 1). To the terminal fitting 40, a high-voltage cable (not shown) is connected via a plug cap (not shown), and a high voltage is applied thereto.

The ground electrode 30 is made of a metal with high corrosion resistance, and for example, a nickel alloy such as INCONEL (trade name) 600 or 601 is used. This ground electrode 30 extends in its longitudinal direction between the base end portion (one end portion) 32 and the distal end portion (the other end portion) 31. The cross section of the ground electrode 30 in a direction orthogonal to this longitudinal direction has substantially a rectangular shape. The base end portion 32 is joined to the front end face 57 of the metal shell 50 by welding. The ground electrode 30 is bent so that one side surface of the distal end portion 31 opposes the electrode tip 90 of the center electrode 20 on the axis line O. This ground electrode 30 forms a spark gap G between the one side surface of the distal end portion 31 and the front end face of the electrode tip 90. In the spark plug 100 of the present embodiment, this spark gap G is set to 0.6 to 1.2 mm.

The metal shell 50 is a cylindrical fitting for fixing the spark plug 100 to the engine head 200 of an internal combustion. The metal shell 50 holds therein a portion of the insulator 10 from a part of the rear side barrel portion 18 to the leg portion 13 by surrounding this portion. The metal shell 50 is made of a low-carbon steel material, and includes a tool engagement portion 51 with which a spark plug wrench not shown engages and an attaching threaded portion 52 having a screw thread formed so as to screw-fit to the attaching threaded hole 201 of the engine head 200 provided on the upper portion of the internal combustion. In the present embodiment, the outer diameter M (nominal diameter) of this attaching threaded portion 52 is set to M14 which is a standard outer diameter, or M12 to M10 which is smaller than M14.

Between the tool engagement portion 51 and the attaching threaded portion 52 of the metal shell 50, a flange-shaped seal portion 54 is formed. To the screw neck 59 between the attaching threaded portion 52 and the seal portion 54, an annular gasket 5 formed by bending a plate member is inserted and fitted. When the spark plug 100 is attached to the engine head 200, the gasket 5 is pressed and deformed between the bearing surface 55 of the seal portion 54 and the opening peripheral portion 205 of the attaching threaded hole 201. This deformation of the gasket 5 makes a sealing between the spark plug 100 and the engine head 200, and air leaks from the inside of the engine via the attaching threaded hole 201 are prevented.

On the further rear end side than the tool engagement portion 51 of the metal shell 50, a thin crimping portion 53 is provided. Between the seal portion 54 and the tool engagement portion 51, a buckling portion 58 which is thin, similar to the crimping portion 53, is provided. Between the inner peripheral surface of the metal shell 50 from the tool engagement portion 51 to the crimping portion 53 and the outer peripheral surface of the rear side barrel portion 18 of the insulator 10, annular ring members 6 and 7 are interposed. Further, between the ring members 6 and 7, powder of talc 9 is filled. By bending the crimping portion 53 inward to crimp it, the insulator 10 is pressed toward the front end side inside the metal shell 50 via the ring members 6 and 7 and the talc 9. Accordingly, on the step portion 56 formed at the position of the attaching threaded portion 52 on the inner periphery of the metal shell 50, the step portion 15 of the insulator 10 is supported via an annular plate packing 8, and the metal shell 50 and the insulator 10 are integrated. At this time, airtightness between the metal shell 50 and the insulator 10 is kept by the plate packing 8, and a combustion gas is prevented from flowing out. The buckling portion 58 is configured to warp and deform outward along with application of a compressing force when crimping, and the compression length in the axis line O direction of talc 9 is made longer and the airtightness inside the metal shell 50 is increased. Between the metal shell 50 and the insulator 10 on the further front end side than the step portion 56, a clearance with a predetermined size is provided.

The above-described spark plug 100 can be produced according to the following production method, for example. First, a center electrode 20 on which the above-described electrode tip 90 has been joined to the electrode base member mount 22 via a fused portion 23, an insulator 10, a metal shell 50, and a ground electrode 30 are prepared. Then, the center electrode 20 is fitted to the insulator 10 so as to cover the outer periphery of the center electrode 20 while exposing the front end portion (specifically, the electrode tip 90, the fused portion 23, and the electrode base member mount 22) of the center electrode 20. Thereafter, the metal shell 50 is fitted to the outer periphery of the insulator 10 such that the front end portion of the insulator 10 protrudes by 1.5 millimeters or more from the front end face of the metal shell 50, and the base end portion of the ground electrode 30 is joined to the front end face 57 of the metal shell 50. Thereafter, the ground electrode 30 is bent such that the distal end portion 31 of the ground electrode 30 opposes the front end portion of the center electrode 20.

Figure 3:
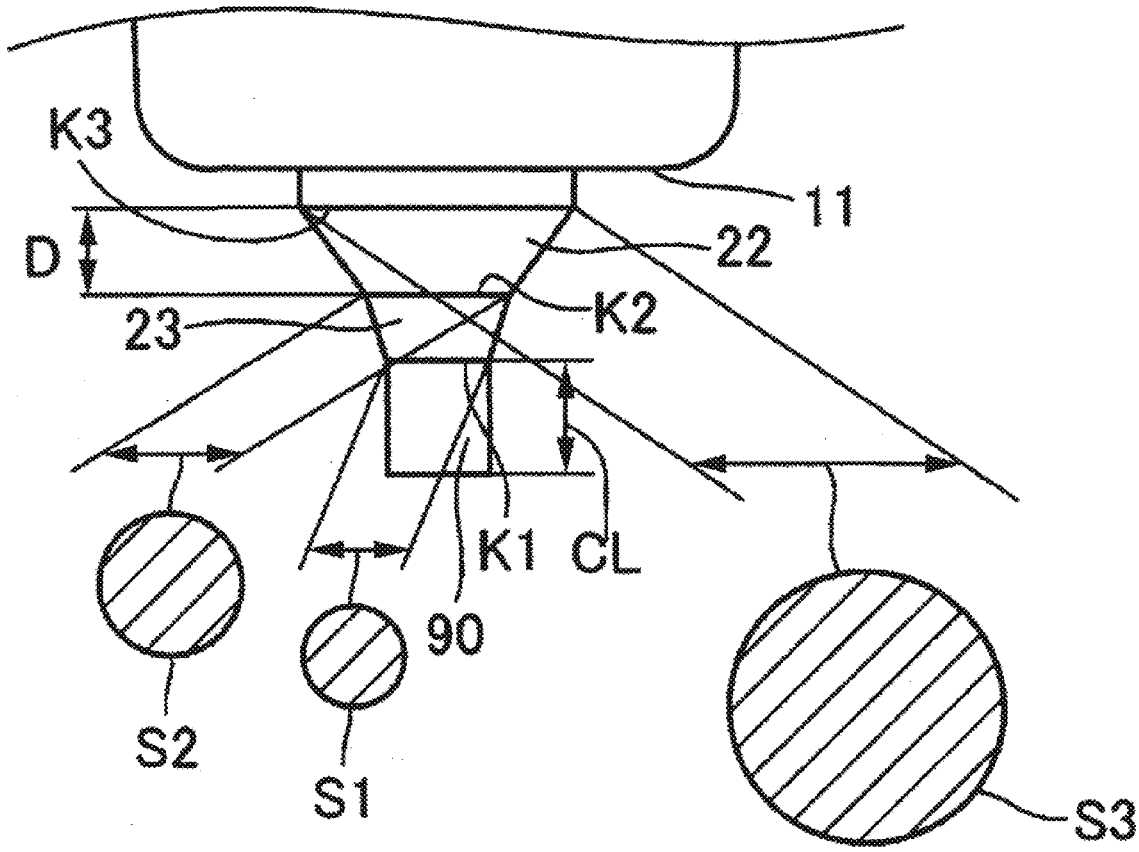
FIG. 3 is a diagram showing only the front end portion of the center electrode shown in FIG. 2.

Next, the center electrode 20 in the spark plug 100 of the present embodiment will be described in detail. FIG. 3 is a diagram showing only the front end portion of the center electrode 20 shown in FIG. 2. As described above, in the center electrode 20, the electrode tip 90 is joined to the tapered electrode base member mount 22 by laser welding, the electrode base member mount 22 and the electrode tip 90 are firmly connected by the fused portion 23 which is an alloy as described above. The electrode base member mount 22, the fused portion 23, and the electrode tip 90 have different constituent materials and are joined and formed through welding. Therefore, at the joint between the electrode tip 90 and the fused portion 23, a boundary (tip side boundary K1) appears. Further, at the joint between the fused portion 23 and the electrode base member mount 22, a boundary (base member side boundary K2) appears. These K1 and K2 can be visually observed from the outside. Here, in the present embodiment, the shortest distance CL (hereinafter, also referred to as a tip effective length) in the axis line direction from the tip side boundary K1 to the front end of the electrode tip 90 is not less than 0.5 mm ($CL \geqq 0.5$ mm).

In the state where the electrode tip 90 has been joined to the electrode base member mount 22 via the fused portion 23, in the present embodiment, the cross section area S1 of the tip side boundary K1 between the fused portion 23 and the electrode tip 90 and the cross section area S2 of the base member side boundary K2 between the fused portion 23 and the electrode base member mount 22 satisfy the relational expression of $S1 < S2$. This relational expression can be satisfied by setting the cross section area of the electrode tip 90 equal to or slightly smaller than the front end area of the tapered electrode base member mount 22. The electrode base member mount 22 is tapered, so that the cross section area S3 of the base portion K3 of the electrode base member mount 22 becomes larger than the cross section area S2 of the base member side boundary K2 as a matter of course.

In addition to this definition of the cross section area at the boundaries, in the present embodiment, the cross section area S2 of the base member side boundary K2 and the cross section area S3 of the base portion K3 of the electrode base member mount 22 are defined as follows. As shown in FIG. 3, when D is the shortest distance in the axis line direction from the base member side boundary K2 to the base portion K3, $(S3-S2)/D$ indicating the area increase rate per unit length from the base member side boundary K2 to the base portion K3 satisfies the relational expression of $5 \leqq (S3-S2)/D \leqq 50$.

Further, regarding the electrode tip 90, the shortest distance (tip effective length) CL in the axis line direction from the tip side boundary K1 to the front end of the electrode tip 90 is associated with the cross section area S1 of the tip side boundary K1 so as to satisfy the relational expression of $1.4 \leqq CL/S1 \leqq 7.2$. Hereinafter, a value (CL/S1) of the tip effective length CL of the electrode tip 90 divided by the cross section area S1 is referred to as a tip length per area.

In this case, after the electrode tip 90 and the distal end portion 31 of the ground electrode 30 are placed in the combustion chamber of the engine head 200, the spark plug 100 is fitted to the internal combustion by the attaching threaded portion 52 with an outer diameter (nominal diameter) of M10 to M14. From these circumstances, the possible values of the cross section area S1 of the tip side boundary K1, the cross section area S2 of the base member side boundary K2, the cross section area S3 of the base portion K3, the shortest distance D in the axis line direction from the base member side boundary K2 to the base portion K3, and the tip effective length CL of the electrode tip 90 are naturally limited. Besides, these cross section areas S1 to S3, the shortest distance D, and the tip effective length CL are set so as to satisfy the above-described relational expressions. In detail, the tip effective length CL is in a range of approximately 0.5 to 1.7 mm, and a radius of the tip side boundary K1 for calculating the cross section area S1, a radius of the base member side boundary K2 for calculating the cross section area S2, and a radius of the base portion K3 for calculating the cross section area S3 are in a range of approximately 0.7 to 1.5 mm.

Figure 4:
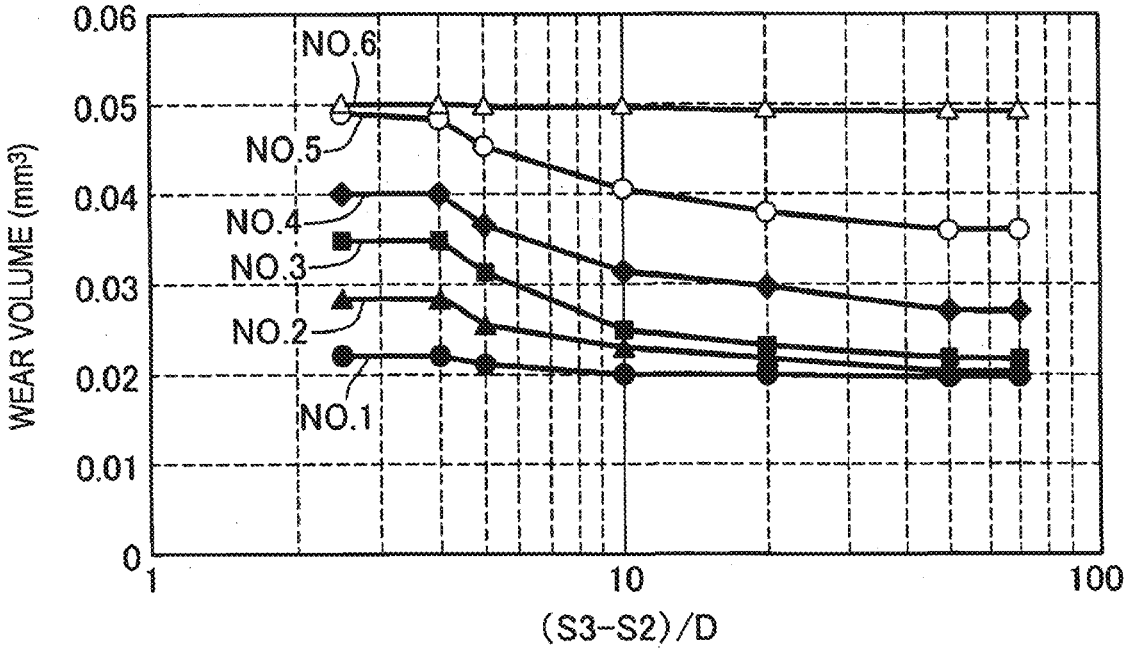
FIG. 4 is a graph showing the results of an evaluation test evaluating a degree of wear of the electrode tip as an evaluation item while variously changing the cross section areas S1 to S3 and the shortest distance D at the front end of the center electrode.
Figure 4:
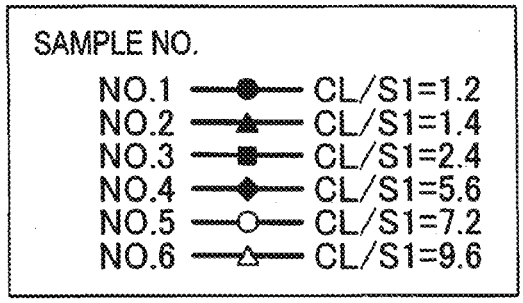
Figure 5:
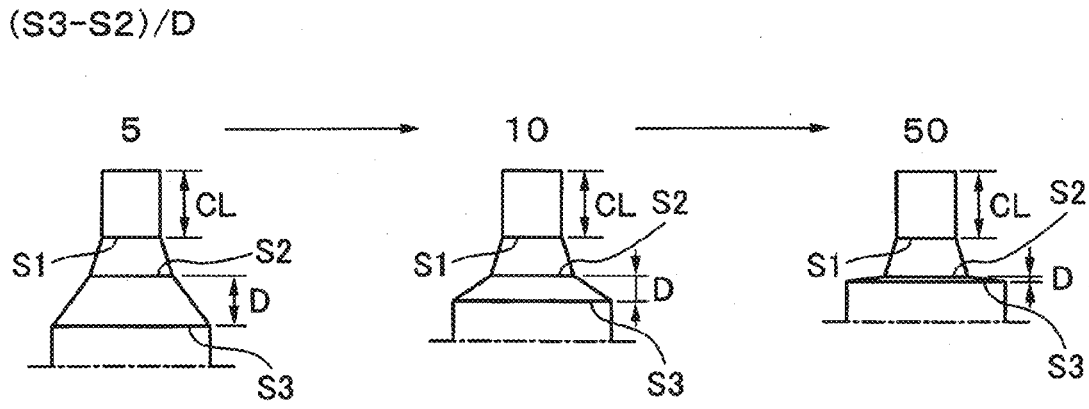
FIG. 5 is a diagram showing shape changes when (S3−S2)/D is changed while the cross section areas S1 to S3 are fixed.

FIG. 4 is a graph showing the results of an evaluation test evaluating a degree of wear of the electrode tip 90 as an evaluation item while setting the tip effective length CL to not less than 0.5 mm and variously changing the cross section areas S1 to S3 and the shortest distance D at the front end portion of the center electrode 20. In the evaluation test, after the spark plug 100 was fitted to a 2000 cc, 6-cylinder engine, the engine was continuously driven for 100 hours at a constant number of rotations of 5000 rpm, and the degrees of wear of the electrode tip 90 before and after the start of the test (wear volume $mm^3$) were measured. The spark plugs as samples used for the measurement were 6 types of spark plugs with tip lengths per area (CL/S1) of the electrode tips 90 shown in FIG. 4, and these 6 types of spark plugs were measured while changing (S3−S2)/D. FIG. 5 is a diagram showing shape changes of the front end portion of the center electrode 20 when (S3−S2)/D was changed upon fixing the cross section areas S1 to S3.

From the test results of FIG. 4, it could be confirmed that the wear of the electrode tip 90 could be reduced by setting (S3−S2)/D to not less than 5 regardless of the tip length per area (CL/S1) of the electrode tip 90. It could also be confirmed that the effect of reducing the wear of the electrode tip 90 became substantially constant after (S3−S2)/D became not less than 50.

Considering the tip length per area (CL/S1) of the electrode tip 90 as well, when this value (CL/S1) is set so as to satisfy $1.4 \leqq CL/S1 \leqq 7.2$, the wear reduction effect of the electrode tip 90 is remarkable as compared with the samples No. 1 and No. 6 of which the value (CL/S1) is outside this range.

From these results, in the case where an electrode tip 90 with a long tip effective length CL not less than 0.5 mm is joined to the electrode base member mount 22 via the fused portion 23, upon setting (S3−S2)/D from the base member side boundary K2 to the base portion K3 to $5 \leqq (S3-S2)/D \leqq 50$, when the tip length per area (CL/S1) of the electrode tip 90 is $1.4 \leqq CL/S1 \leqq 7.2$, the wear reduction effect of the electrode tip 90 can be significantly increased while the electrode tip 90 is made longer.

Since degree of wear of the electrode tip 90 is influenced by heat conduction from the electrode tip 90, the test results shown in FIG. 4 will be described in relation to the heat conduction.

As shown in FIG. 3, the electrode tip 90 is joined to the electrode base member mount 22 via the fused portion 23, and from the electrode tip 90 to the base portion K3 of the electrode base member mount 22 via the fused portion 23, the cross section area increases in order of S1<S2<S3 from the electrode tip 90 side. In the range of the tip length per area (CL/S1) of the electrode tip 90 less than 1.4, the tip effective length CL of the electrode tip 90 is short and the electrode tip 90 itself is small. The spark plug thus configured corresponds to Sample No. 1 (CL/S1=1.2) of FIG. 4, and heat conduction of the electrode tip 90 is satisfactory. Therefore, as shown in Sample No. 1 (CL/S1=1.2), due to the small electrode tip 90, the degree of wear of the electrode tip 90 is naturally small, and regardless of (S3−S2)/D, the degree of wear of the electrode tip 90 does not change. In other words, when the cross section area is expanded as described above, the electrode tip 90 itself as a target from which heat is conducted is small, so that heat conduction from the electrode tip 90 is accordingly satisfactory, and the degree of wear of the electrode tip 90 is not reduced by changing (S3−S2)/D.

On the other hand, in Sample No. 6 (CL/S1=9.6) in which the electrode tip 90 has a tip length per area (CL/S1) more than 7.2, the tip effective length CL of the electrode tip 90 is extremely long, so that the electrode tip 90 becomes large. Therefore, even when the cross section area is expanded as described above, heat conduction of the electrode tip 90 itself is very poor, so that as shown in FIG. 4, even if (S3−S2)/D is changed, the degree of wear of the electrode tip 90 is left still high.

On the other hand, in Samples No. 2 to No. 5 with tip lengths per area (CL/S1) satisfying the relational expression of $1.4 \leqq CL/S1 \leqq 7.2$, when (S3−S2)/D becomes not less than 5, the degree of wear of the electrode tip 90 is greatly reduced and the durability is improved. This is attributed to the facts that the shortest distance D between the base member side boundary K2 and the base portion K3 becomes smaller due to the large value of (S3−S2)/D (see FIG. 5), that is, the heat propagation distance from the base member side boundary K2 to the base portion K3 of the electrode base member mount 22 becomes shorter, and the heat propagation area at the time of heat propagation rapidly spreads due to the large value of (S3−S2)/D, in addition to the above-described expansion of the cross section area from the electrode tip 90 to the fused portion 23 and the base portion K3. Therefore, even when the tip effective length CL is made longer so as to satisfy the relational expression of $1.4 \leqq CL/S1 \leqq 7.2$, that is, even when the electrode tip 90 is made longer, the heat conduction from the electrode tip 90 can be satisfactorily made. As a result, both of an improvement in ignition performance and an improvement in durability can be realized while the electrode tip 90 is made longer.

Figure 6:
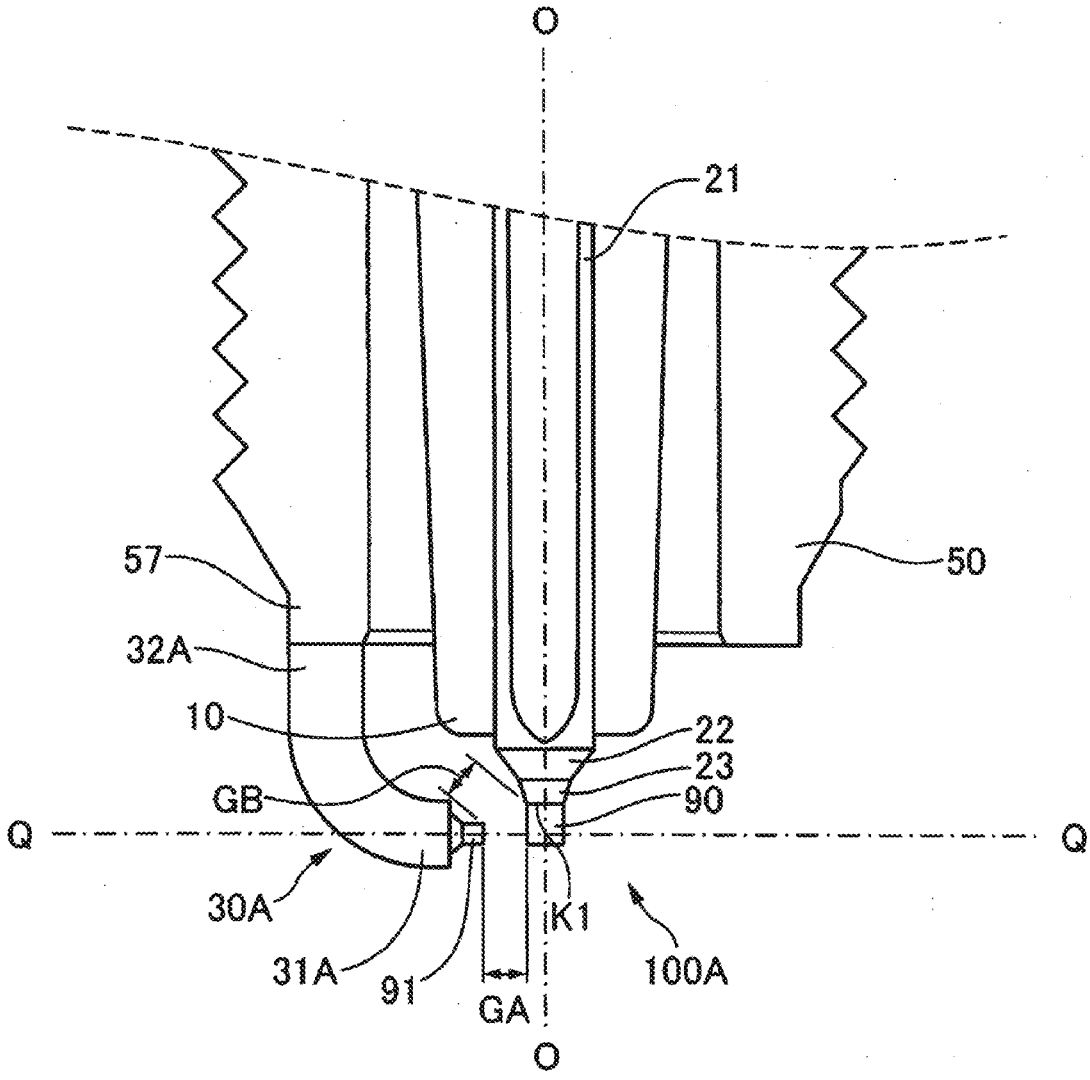
FIG. 6 is an enlarged view of the vicinity of the front end of a center electrode in a spark plug of another embodiment.

Next, another embodiment will be described. FIG. 6 is an enlarged view of the vicinity of the front end of a center electrode 20 in a spark plug 100A of another embodiment. This embodiment is different from the aforementioned embodiment in the configuration in which the ground electrode 30A forms a spark gap GA so that the distal end portion (the other end portion) 31A opposes the side surface of the electrode tip 90.

As shown in the figure, in the spark plug 100A, as described above, an electrode tip 90 is joined to the electrode base member mount 22 on the front end of the electrode base member 21 via a fused portion 23. The spark plug 100A includes a ground electrode 30A. The base end portion (one end portion) 32A of the ground electrode 30A is welded and joined to the front end face 57 of the metal shell 50. The ground electrode 30A is bent so that the end face of the distal end portion (the other end portion) 31A of the ground electrode 30A opposes the side surface of the electrode tip 90 of the center electrode 20. The electrode tip 91 is joined to the end face of the distal end portion 31A of the ground electrode 30A. The distal end face of the electrode tip 91 opposes the side surface of the electrode tip 90 on the axis Q perpendicular to the axis line O, and a spark gap GA is formed between the distal end face of the electrode tip 91 and the side surface of the electrode tip 90. In the spark plug 100A of the present embodiment, this spark gap GA is also set to 0.3 to 1.2 mm. The electrode tip 91 on the ground electrode 30A side is a noble metal tip formed by containing a noble metal as a major component similar to the electrode tip 90 on the center electrode 20 side, and a Pt-20Rh alloy (a platinum alloy containing rhodium in an amount of 20 mass %) and a Pt-20Ir-5Rh alloy (a platinum alloy containing iridium in an amount of 20 mass % and rhodium in an amount of 5 mass %), etc., are frequently used.

In the spark plug 100A shown in FIG. 6, the electrode tip 90 is disposed with the above-described relationship of cross section areas from the electrode tip 90 to the electrode base member mount 22. To form the spark gap GA between the distal end face of the electrode tip 91 and the side surface of the electrode tip 90, the following relational expression is defined. That is, as shown in FIG. 6, the spark gap GA formed by the side surface of the electrode tip 90 and the distal end face of the electrode tip 91 is set so as to satisfy the relational expression of $GB/GA \geqq 1.05$ with respect to the shortest distance GB from the distal end face of the electrode tip 91 to the tip side boundary K1. Although FIG. 6 shows a spark plug in which the distal end face of the electrode tip 91 opposes the side surface of the electrode tip 90 on the axis Q perpendicular to the axis line O, the distal end face of the electrode tip 91 may oppose the side surface of the electrode tip 90 on an axis crossing the axis line O at a predetermined angle. Even in this case, the spark gap GA and the shortest distance GB are defined so as to satisfy the above-described relational expression.

Figure 7:
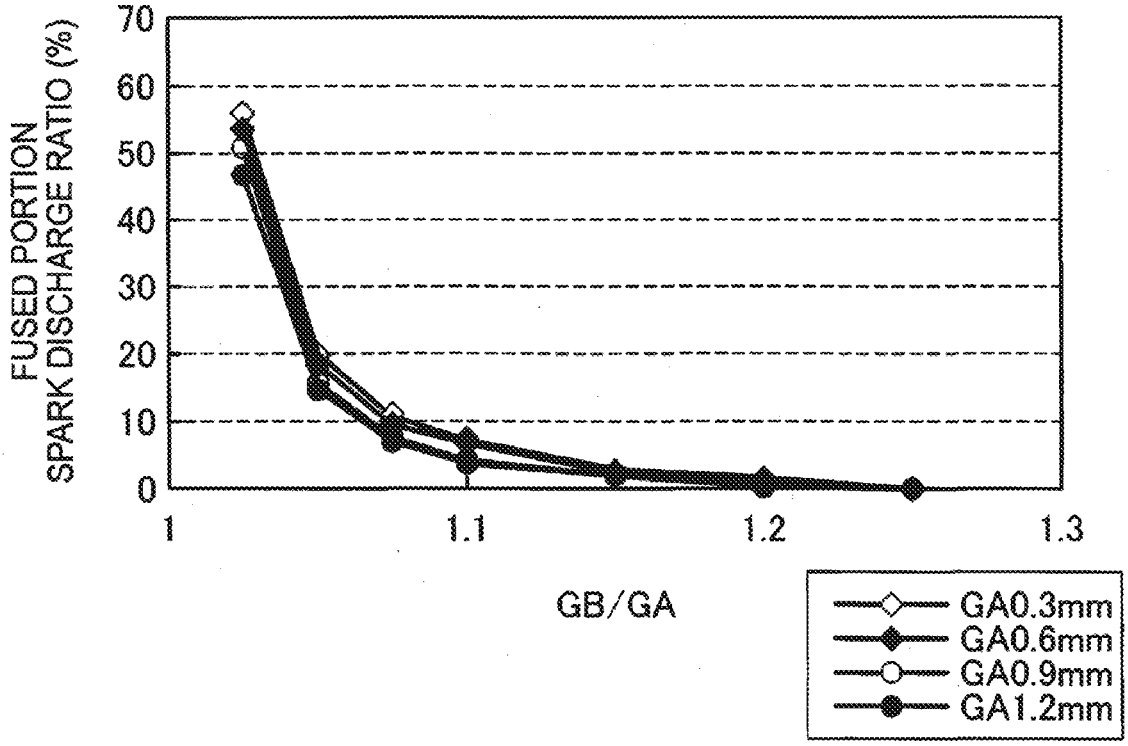
FIG. 7 is a graph showing the results of an evaluation test evaluating an incidence ratio of spark discharge from the fused portion to the electrode tip as a fused portion spark discharge ratio while variously changing the spark gap GA.

FIG. 7 is a graph showing the results of an evaluation test evaluating an incidence ratio of spark discharge from the fused portion 23 to the electrode tip 91 as a fused portion spark discharge ratio while variously changing the spark gap GA. This evaluation test is for investigating a spark discharge ratio to the fused portion 23 when a high voltage is applied to the sample spark plugs upon attaching the sample spark plugs inside the pressure chamber having a pressure set to 0.4 MPa in an ambient atmosphere. As in the present embodiment, since the fused portion 23 for joining the electrode tip 90 to the electrode base member mount 22 is formed through melting by laser welding, the surface of the fused portion has minute irregularities and an oxide film, so that spark discharge to the electrode tip 91 may occur from the surface of the fused portion 23, more specifically, from the tip side boundary K1 with the shortest distance to the distal end periphery of the electrode tip 91.

It was decided to make the measurement of the fused portion spark discharge ratio for the following reason. In a high compression ratio engine which has spread greatly in recent years, the combustion chamber pressure is high. Therefore, for a ground electrode which is curved and extended toward the center electrode side, an improvement in strength of the curved portion in an environment with a high compression ratio and a high combustion pressure are demanded more than in an existing engine, and reduction in length of the ground electrode is desirable. From the viewpoint of discharge reliability between the short-length ground electrode and the center electrode, in a spark plug having a spark gap formed around the center electrode, the ground electrode opposes the side surface of the center electrode, more specifically, the side surface of the noble metal tip (electrode tip 90) on the front end of the center electrode. In this case, if the ground electrode simply opposes the side surface of the noble metal tip on the front end of the center electrode, the ignition performance may deteriorate. In other words, since the fused portion which is a joint portion between the noble metal tip and the center electrode front end is an alloy formed through melting of the electrode constituent material (for example, nickel) and the noble metal, minute irregularities or an oxide film due to melting are present on the surface of the fused portion, so that fused portion spark discharge may occur which cause discharge between the fused portion and the ground electrode. Since the fused portion is on the base portion side of the noble metal tip, that is, away from the combustion chamber, it is estimated that even if spark discharge occurs between the fused portion and the ground electrode, the spark discharge does not result in fuel ignition in the combustion chamber. Therefore, the situation of occurrence of spark discharge from the side surface of the fused portion 23 is investigated, and the results of the investigation are shown in the graph of FIG. 7.

In the graph shown in FIG. 7, the X axis shows a ratio GB/GA of the shortest distance GB to the spark gap GA, and the Y axis shows a fused portion spark discharge ratio (%). From the test results shown in FIG. 7, it was confirmed that, regardless of the spark gap GA, the fused portion spark discharge ratio could be reduced to 20% or less by setting the ratio of the shortest distance GB to the spark gap GA to not less than 1.05. In addition, it was found that the fused portion spark discharge ratio could be almost completely prevented when the ratio of the shortest distance GB to the spark gap GA exceeded 1.2.

Embodiments of the present invention are described above, however, the present invention is not limited to the embodiments, and various configurations are possible without departing from the scope of the present invention. For example, the following modifications are possible.

In the spark plug 100 shown in FIG. 1 to FIG. 3, the front end face of the electrode tip 90 opposes one side surface of the ground electrode 30. However, the electrode tip 91 shown in FIG. 6 can also be provided on the surface of the electrode tip 90 opposing the ground electrode 30.

Figure 8:
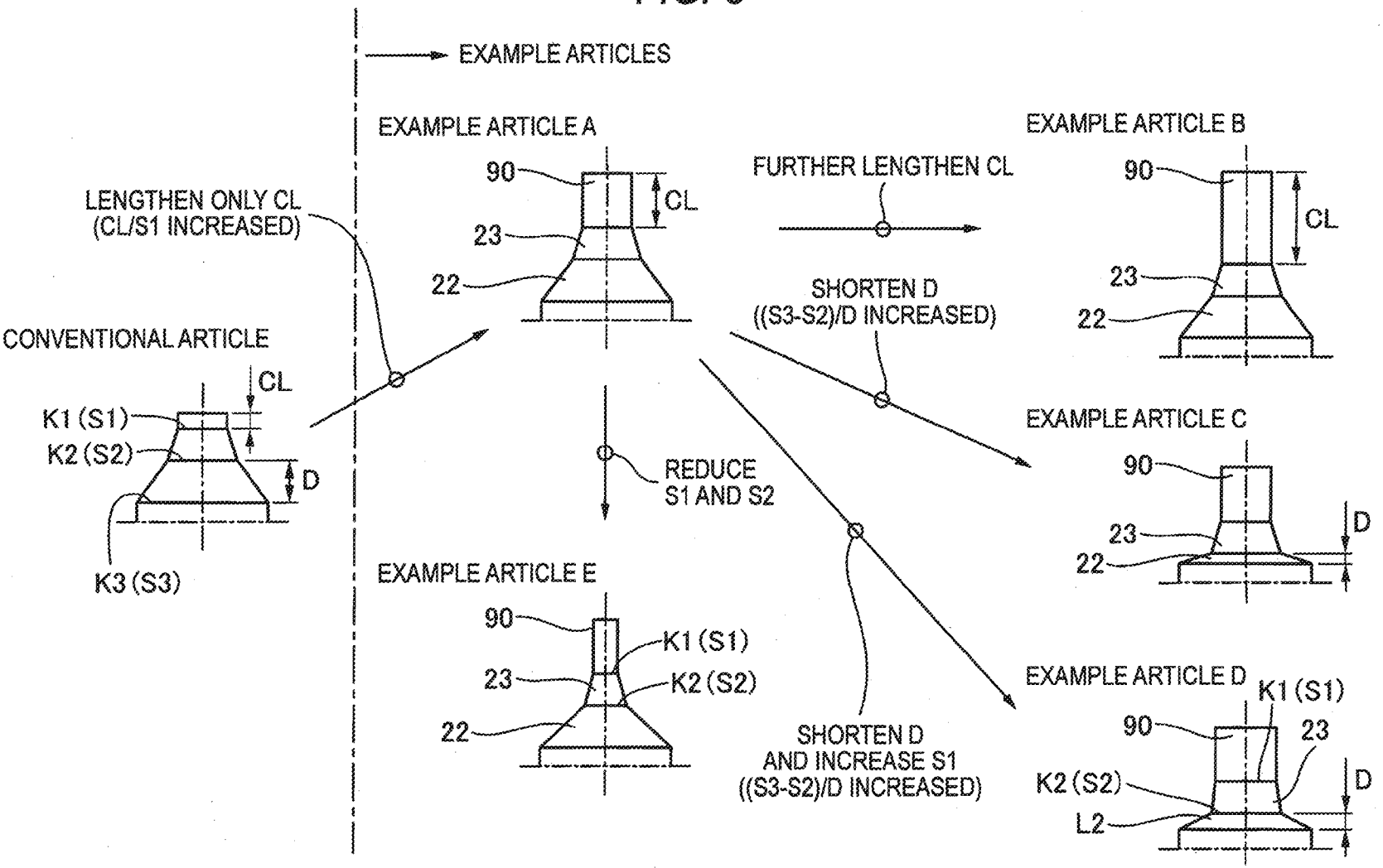
FIG. 8 is a diagram showing a form change from a conventional spark plug to an example article A and a further form change from this example article A.

Further, the electrode tip 90 and the electrode base member mount 22 can be variously formed as long as (S3−S2)/D from the base member side boundary K2 to the base portion K3 and the tip length per area (CL/S1) of the electrode tip 90 satisfy the relationship of $5 \leqq (S3-S2)/D \leqq 50$ and the relationship of $1.4 \leqq CL/S1 \leqq 7.2$. FIG. 8 is a diagram showing a form change from a conventional spark plug to an example article A and a further form change from this example article A. With any of the forms shown in FIG. 8, as a matter of course, the above-described effect can be obtained by satisfactory heat conduction from the electrode tip 90 as long as (S3−S2)/D and the tip length per area (CL/S1) satisfy the above-described relational expressions.

As shown in FIG. 8, the example article A corresponds to the above-described spark plug 100 or 100A, and the tip length per area (CL/S1) is increased by making longer only the tip effective length CL of the electrode tip 90. When the tip effective length CL is thus increased, the shortest distance GB can be secured while the fused portion 23 and the electrode tip 91 are reliably separated as shown in FIG. 6, so that the effectiveness of reducing the fused portion spark discharge increases.

The example article B is formed in which the tip effective length CL is made longer than that in the example article A in the range of the tip length per area (CL/S1) satisfying the above-described relationship. In the example article C, (S3−

S2)/D is increased by shortening the shortest distance D from the base member side boundary K2 to the base portion K3, so that heat conduction from the electrode tip 90 increases. The example article D is formed in which the cross section area S1 (tip cross section area) at the tip side boundary K1 is increased upon shortening the shortest distance D, and in this form, by increasing (S3−S2)/D and the cross section area S1, heat conduction from the electrode tip 90 can be improved. The example article E is formed in which the cross section area of the electrode tip 90, that is, the cross section area S1 of the tip side boundary K1 is made smaller than that in the example article A in the range of the tip length per area (CL/S1) satisfying the above-described relationship.

This application is based on Japanese Patent Application (No. 2007-300824) filed on Nov. 20, 2007 and Japanese Patent Application (No. 2008-27969) filed on Feb. 7, 2008, contents of which are incorporated herein by reference.

The invention claimed is:

1. A spark plug comprising:

a center electrode;

an insulating body which has an axial hole extending in an axis line direction and holds the center electrode in the axial hole;

a metal shell which holds the insulating body and surrounds a radial periphery of the insulating body; and a ground electrode having one end portion joined to the metal shell, the ground electrode being bent such that an other end portion opposes a front end portion of the center electrode so as to form a spark gap between the other end portion and the center electrode, wherein the center electrode comprises: an electrode base member comprising an electrode base member mount tapered in a front end portion thereof such that a diameter thereof is reduced toward a front end side; and a noble metal tip joined to a front end surface of the electrode base member mount, wherein the noble metal tip and the electrode base member are joined via a fused portion in which a component of the noble metal tip and a component of the electrode base member mount are fused, and CL>0.5 mm is satisfied where CL is a shortest distance in the axis line direction from a tip side boundary defined between the fused portion and the noble metal tip to a front end of the noble metal tip, and wherein $$S1<S2 \text{ and}$$

$$5\text{ mm} \leqq (S3-S2)/D \leqq 50\text{ mm}$$

are satisfied where S1 is a cross section area of the tip side boundary, S2 is a cross section area of a base member side boundary defined between the fused portion and the electrode base member mount, S3 is a cross section area of a base portion of the electrode base member mount, and D is a shortest distance in the axis line direction from the base member side boundary to the base portion, wherein the center electrode is held by the insulating body in a state where at least the noble metal tip, the fused portion, and the electrode base member mount are exposed from the insulating body, wherein the ground electrode is bent such that the other end portion of the ground electrode opposes a side surface of the noble metal tip, and the spark gap GA is formed between the other end portion of the ground electrode and the side surface of the noble metal tip, and wherein $$GB/GA>1.05$$

is satisfied where GB is a shortest distance from the other end portion of the ground electrode to the tip side boundary.

2. The spark plug according to claim 1, wherein 1.4[1/mm]≦CL/S1≦7.2[1/mm] is satisfied.

* * * * *